US008997704B2

(12) United States Patent
Weber et al.

(10) Patent No.: US 8,997,704 B2
(45) Date of Patent: Apr. 7, 2015

(54) APPARATUS FOR THE VARIABLE SETTING OF THE CONTROL TIMES OF GAS EXCHANGE VALVES OF AN INTERNAL COMBUSTION ENGINE

(75) Inventors: Juergen Weber, Erlangen (DE); Andreas Schulte, Nuernberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 528 days.

(21) Appl. No.: 12/419,805

(22) Filed: Apr. 7, 2009

(65) Prior Publication Data

US 2009/0250026 A1 Oct. 8, 2009

(30) Foreign Application Priority Data

Apr. 8, 2008 (DE) ..... 10 2008 017 688

(51) Int. Cl.
*F01L 1/34* (2006.01)
*F01L 1/344* (2006.01)
*F01L 1/053* (2006.01)

(52) U.S. Cl.
CPC ..... *F01L 1/3442* (2013.01); *F01L 2001/0537* (2013.01); *F01L 2001/34469* (2013.01); *F01L 2001/34479* (2013.01); *F01L 2001/34483* (2013.01); *F01L 2101/00* (2013.01); *F01L 2103/00* (2013.01); *F01L 2103/01* (2013.01)

(58) Field of Classification Search
USPC ..... 123/90.17, 90.15; 411/143; 464/160, 464/161
See application file for complete search history.

(56) References Cited

U.S. PATENT DOCUMENTS

| | | | | |
|---|---|---|---|---|
| 3,133,579 | A * | 5/1964 | Grimm et al. | 411/180 |
| 6,669,567 | B1 * | 12/2003 | Scheidt et al. | 464/2 |
| 7,117,832 | B2 * | 10/2006 | Naumann et al. | 123/90.17 |
| 7,591,623 | B2 * | 9/2009 | Parker | 411/180 |
| 7,765,967 | B2 * | 8/2010 | Kira | 123/90.17 |
| 2007/0231105 | A1 * | 10/2007 | Parker | 411/180 |
| 2008/0003893 | A1 * | 1/2008 | Frenken | 439/813 |

FOREIGN PATENT DOCUMENTS

EP 0806550 A1 11/1997

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

An apparatus for variable setting of control times of gas exchange valves of an internal combustion engine which has a drive element an output element and a side cover. The drive element is brought into drive connection with a crankshaft, the output element is brought into drive connection with a camshaft, and the output element is arranged such that it can be pivoted with respect to the drive element. The side cover, which has a sealing cover with an opening and a mating element, axially delimits the output element and/or the drive element, and is connected in a rotationally fixed manner to the drive or output element by means of a fastening element. The fastening element reaches at least partially through the opening and interacts with the fastening element producing a rotationally fixed connection between the side cover and output element or drive element.

9 Claims, 5 Drawing Sheets

34
35
36
37
38
39, 47
40
47
48

APPARATUS FOR THE VARIABLE SETTING OF THE CONTROL TIMES OF GAS EXCHANGE VALVES OF AN INTERNAL COMBUSTION ENGINE

This application claims the priority of DE 102008017688.5 filed Apr. 8, 2008, which is incorporated by reference herein.

FIELD OF THE INVENTION

The invention relates to an apparatus for the variable setting of the control times of gas exchange valves of an internal combustion engine, having a drive element, an output element and at least one side cover, it being possible for the drive element to be brought into drive connection with a crankshaft of the internal combustion engine, it being possible for the output element to be brought into drive connection with a camshaft of the internal combustion engine, and said output element being arranged such that it can be pivoted with respect to the drive element, the side cover axially delimiting the output element and/or the drive element and being connected in a rotationally fixed manner to the drive element or the output element by means of at least one fastening element, the side cover having a sealing cover and at least one mating element, the sealing cover being composed at least partially of a metallic material and having at least one opening, and the fastening element reaching through the opening at least partially and interacting with the fastening element in such a way that a rotationally fixed connection can be produced between the side cover and the output element or the drive element. Furthermore, the invention relates to methods for producing a side cover with a sealing cover and at least one mating element which is produced separately from the sealing cover, for an apparatus for the variable setting of the control times of gas exchange valves.

BACKGROUND OF THE INVENTION

Apparatuses for the variable setting of the control times of gas exchange valves are used in modern internal combustion engines, in order for it to be possible to configure the phase relation between the crankshaft and the camshaft in a variable manner in a defined angular range, between a maximum early position and a maximum late position. For this purpose, the apparatus is integrated into a drive train, via which torque is transmitted from the crankshaft to the camshaft. This drive train can be realized, for example, as a belt, chain or gearwheel drive.

An apparatus of this type is known, for example, from EP 0 806 550 B1. The apparatus comprises an output element which is rotatably arranged with respect to a drive element, the drive element being drive-connected to the crankshaft and the output element being connected to the camshaft in a rotationally fixed manner. The apparatus is delimited in the axial direction in each case by one side cover. Here, a plurality of screws engage through the one side cover and the drive element. A region of greater thickness is provided per screw on the other side cover, in which region a thread is formed, into which the screw is screwed. The output element, the drive element and the two side covers delimit a plurality of pressure spaces, each of the pressure spaces being divided by means of a vane into two pressure chambers which act against one another. The vanes are displaced within the pressure spaces by feeding pressure medium to or discharging pressure medium from the pressure chambers, as a result of which targeted rotation of the output element with respect to the drive element and therefore of the camshaft with respect to the crankshaft is brought about.

A disadvantage of this embodiment is the complicated structure of the side cover which carries the threads. Regions of greater thickness have to be provided on the side cover, in order to impart the necessary strength to the screw connection. As a result, the weight of the apparatus is increased. Furthermore, the side cover has to be configured as an expensive sintered component.

OBJECT OF THE INVENTION

The invention is based on the object of providing an apparatus for the variable setting of the control times of gas exchange valves of an internal combustion engine, functionally reliable fastening of the side cover to the apparatus being realized in a manner with optimized weight and costs.

According to the invention, the object is solved by the fact that the mating element is configured separately with respect to the sealing cover and is connected to the latter in a non-positive, positive or material-to-material manner. In this embodiment, the side cover is configured in multiple pieces, the mating elements being produced separately from the actual side cover and only subsequently being mounted on the latter. The side cover serves mainly for sealing the pressure chambers in the axial direction. As a result of the separate production of the sealing or side covers and the mating elements, the structure of the sealing cover can be reduced to its actual task, for example, it can be configured as a simple, thin-walled component. This can be carried out inexpensively, for example by being punched from a metal sheet of suitable thickness or by deep drawing processes. Here, both steel sheets and sheets made from lightweight metal, for example from aluminum, magnesium or the like, may be suitable. The fastening elements can be screws, for example. In this case, the mating elements are configured as thread carriers, for example threaded nuts, the thread section of the screws being screwed to the thread section of the nuts. As an alternative, the fastening elements can be configured as bolts, for example. In this case, the mating elements can be configured as annular bodies. The bolts engage in each case into one of the annular bodies and are welded to the latter. In these embodiments, the side covers can be composed of lightweight material, for example plastic, aluminum or the like. In this embodiment, only the fastening elements and mating elements have to be composed of weldable material, for example steel. The weight of the apparatus can therefore be reduced considerably. A further possibility comprises realizing a clip connection by the fastening element and the mating element.

In one embodiment, in which the sealing cover is composed of a lightweight metal material, there may be provision for the mating element to be composed of the same material as the fastening elements which engage into it. This prevents the connection from being released during operation on account of different coefficients of thermal expansion, the weight of the apparatus being reduced at the same time by the use of lightweight material. At the same time, corrosion problems can be avoided as a result, since the fastening is effected between components of the same material. Furthermore, the fastening elements and the mating elements can be produced from a suitable, strong material, with the result that the connection, for example the threads of a screw connection, have/has the necessary stability, while the side covers are produced from lightweight material.

In one development of the invention, the mating element has an axial projection, the free end of which engages into the corresponding opening, the external diameter of the projection being adapted at least in one region to the internal diameter of the opening and being smaller than the external diameter of the remaining mating element. In this case, the projection serves as a centering collar which fixes and secures the position of the mating element in the opening during mounting. There can be provision here for the mating element to have an axial stop which bears against an axial side face of the sealing cover when the mating element is mounted. A defined insertion depth of the mating element is fixed by the axial stop. The axial stop can be configured, for example, as an annular face. The annular face can be provided, for example, with anti-rotation safeguard elements which extend in the axial direction starting from the annular face. During the mounting, the anti-rotation safeguard elements are pressed into the axial side face of the side cover, as a result of which the mating elements are secured at least against rotation about its axis with regard to the opening.

Furthermore, the non-positive, positive or material-to-material connection can be produced between a circumferential face of the opening and the projection.

There can be provision here for the mating element to be fixed on the sealing cover by means of a press fit between the projection and the circumferential face of the opening. As an alternative, the projection can be provided with positively locking elements which engage into the circumferential face of the opening. Additional centering of the mating element and securing of the mating element against rotation and against loss during mounting are achieved by the production of a press fit or by pressing regions of the projection into the wall of the opening.

In a further implementation, there is provision for the side cover to be produced separately from the output element and the drive element.

According to the invention, the object is achieved by a method for producing a side cover with a sealing cover and at least one mating element which is produced separately from the sealing cover, for an apparatus for the variable setting of the control times of gas exchange valves of an internal combustion engine, having the following method steps:

- production of the sealing cover which comprises a metallic material,
- formation of at least one opening on the sealing cover,
- production of the mating element,
- positioning of the mating element on the opening, and
- production of the material-to-material connection between the sealing cover and the mating element.

In an alternative embodiment, the object is achieved according to the invention by a method for producing a side cover with a sealing cover and at least one mating element which is produced separately from the sealing cover and has a projection, for an apparatus for the variable setting of the control times of gas exchange valves of an internal combustion engine, having the following method steps:

- production of the sealing cover which comprises a metallic material,
- formation of at least one opening on the sealing cover,
- production of the mating element, the outer contour of the projection of the mating element being of oversized configuration with respect to the opening of the sealing cover,
- pressing of the projection into the opening.

In an alternative embodiment, the object is achieved according to the invention by a method for producing a side cover with a sealing cover and at least one mating element which is produced separately from the sealing cover and has a projection, for an apparatus for the variable setting of the control times of gas exchange valves of an internal combustion engine, having the following method steps:

- production of the sealing cover which comprises a metallic material,
- formation of at least one opening on the sealing cover,
- production of the mating element, the outer contour of the projection of the mating element being adapted to the opening of the sealing cover,
- positioning of the projection in the opening,
- pressing of positively locking elements of the mating element into the sealing cover.

Here, the positively locking elements can be formed on the projection and can be pressed into the wall of the opening by radial widening of the projection. In one alternative embodiment, the mating element has anti-rotation safeguard elements which extend in the axial direction. Said anti-rotation safeguard elements are pressed into the side face of the sealing cover by application of an axial force. This advantageously takes place in a region of the sealing cover which surrounds the opening.

BRIEF DESCRIPTION OF THE DRAWINGS

Further features of the invention result from the following description and from the drawings, in which one exemplary embodiment of the invention is shown in simplified form. In the drawings.

DETAILED DESCRIPTION OF THE DRAWINGS

Figure 1:
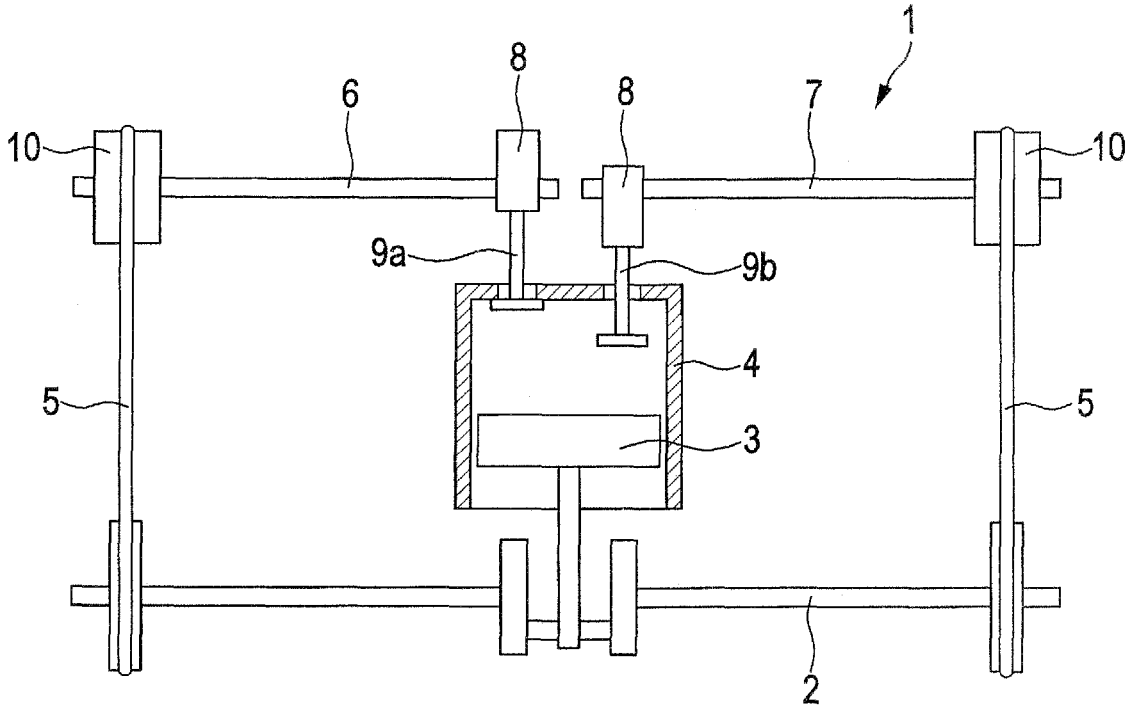
FIG. 1 shows an internal combustion engine, but only in a very schematic manner.

FIG. 1 outlines an internal combustion engine 1, a piston 3 which is seated on a crankshaft 2 being indicated in a cylinder 4. In the embodiment shown, the crankshaft 2 is connected to an inlet camshaft 6 and outlet camshaft 7 via in each case one flexible drive 5, it being possible for a first and a second apparatus 10 to ensure a relative rotation between the crankshaft 2 and the camshafts 6, 7. Cams 8 of the camshafts 6, 7 actuate one or more inlet gas exchange valves 9*a* and one or more outlet gas exchange valves 9*b*. There can likewise be provision for only one of the camshafts 6, 7 to be equipped with an apparatus 10, or for only one camshaft 6, 7 to be provided which is furnished with an apparatus 10.

Figure 3:
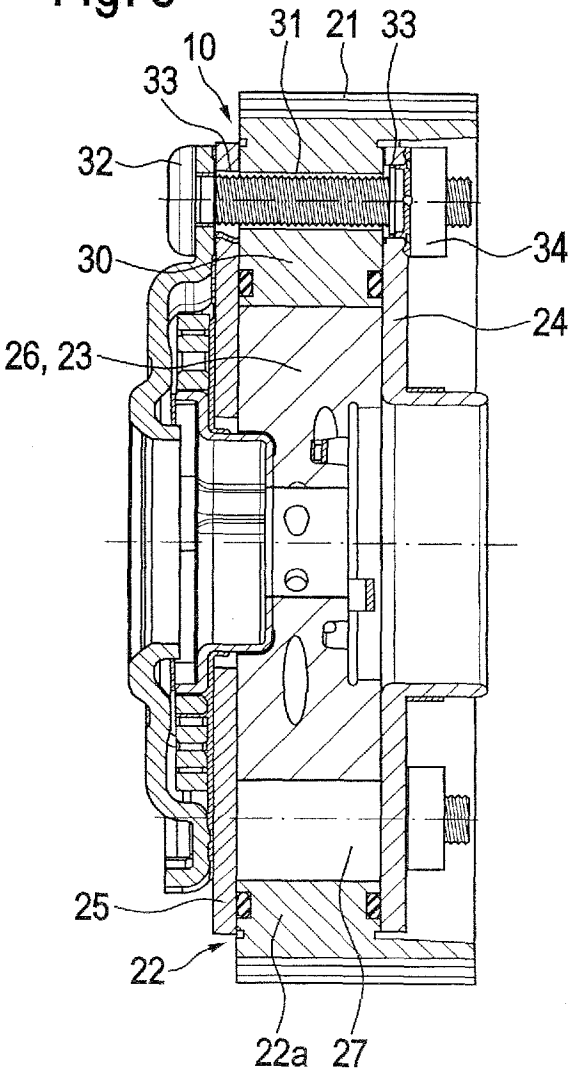
FIG. 3 shows a longitudinal section through the apparatus from FIG. 2*a* along the line IIB-IIB.
Figure 2:
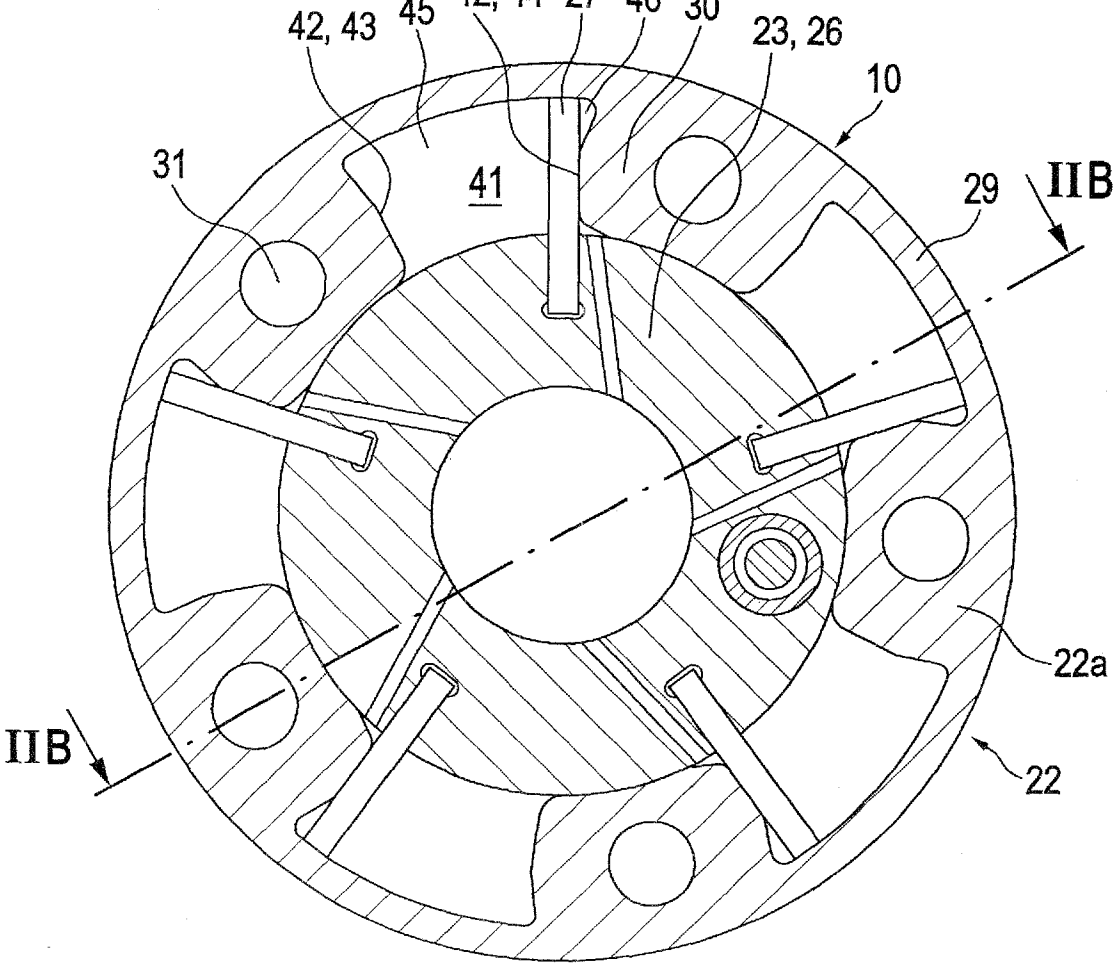
FIG. 2 shows a cross section through one embodiment according to the invention of an apparatus for changing the control times of gas exchange valves of an internal combustion engine.

FIGS. 2 and 3 show a first embodiment of an apparatus 10 according to the invention in cross section and in longitudinal section, respectively.

The apparatus 10 has a drive element 22 and an output element 23. The drive element 22 has a housing 22*a* and two side covers 24, 25 which are arranged on the axial side faces of the housing 22*a*. The output element 23 is configured in the form of an impeller wheel and has a hub element 26 which is of substantially cylindrical configuration and from the outer cylindrical circumferential face of which five vanes 27 extend to the outside in the radial direction in the embodiment shown.

Starting from an outer circumferential wall 29 of the housing 22*a*, a plurality of side walls 30 extend radially to the inside. In the embodiment shown, the side walls 30 are configured in one piece with the circumferential wall 29. The drive element 22 is mounted on the output element 23 by means of circumferential walls of the side walls 30 which lie radially to the inside, such that said drive element 22 can be rotated relative to said output element 23.

A pulley 21 is arranged on an outer circumferential face of the circumferential wall 29, via which pulley 21 torque can be transmitted from the crankshaft 2 to the drive element 22 by means of a belt drive (not shown). In the mounted state, the output element 23 is connected to a camshaft (not shown) by means of a central screw (not shown). To this end, the central screw reaches through a central hole of the output element 23 and is screwed to the camshaft.

In each case one of the side covers 24, 25 is arranged on one of the axial side faces of the housing 22*a* and is fixed on said housing 22*a* in a rotationally fixed manner. For this purpose, an axial opening 31 is provided in each side wall 30. Furthermore, in each case five openings 33 which are arranged in such a way that they are aligned with the axial openings 31 are provided in the side covers 24, 25. On that side of the first side cover 24 which faces away from the drive element 22, each opening 33 is assigned a mating element 34, a thread carrier in this exemplary embodiment, the thread section 37 of said mating element 34 being aligned with the respective opening 33. In each case one fastening element 32 (a screw in the embodiment shown) reaches through an opening 33 of the second side cover 25, an axial opening 31 and an opening 33 of the first side cover 24. Here, a thread section of the screw 32 engages into the thread section 37 of the thread carrier 34.

Figure 5:
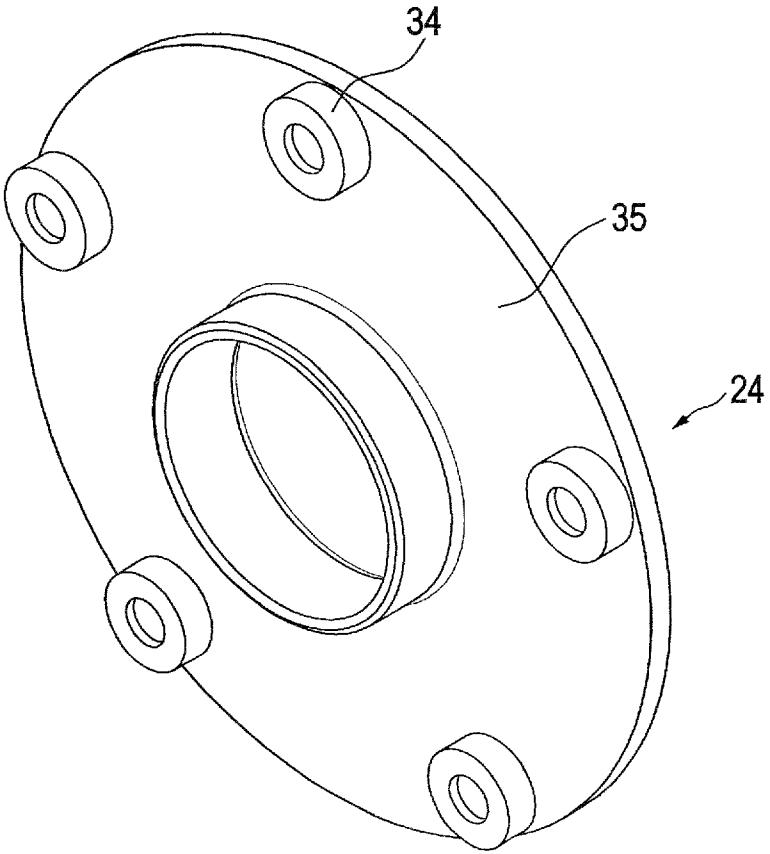
FIG. 5 shows a perspective illustration of a side cover.
Figure 4:
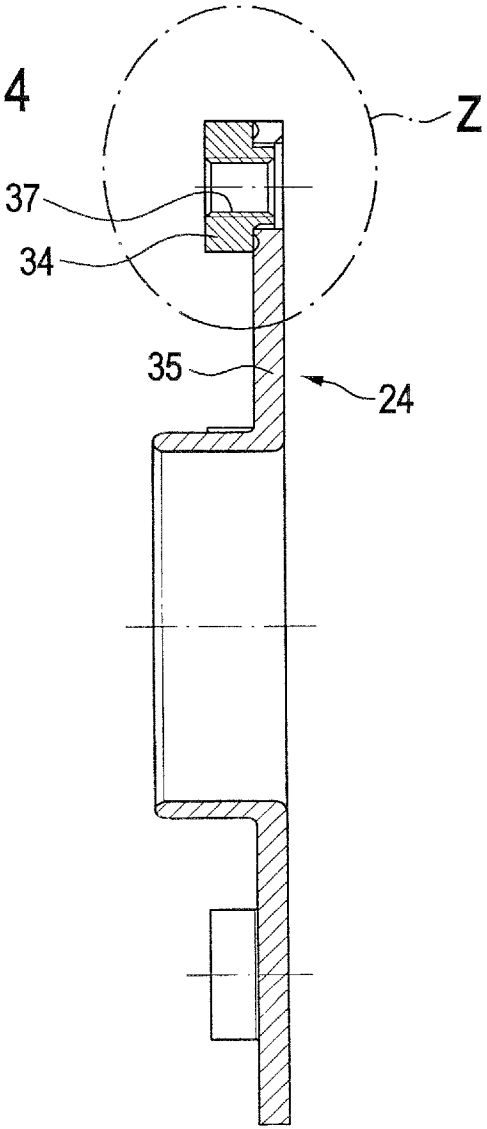
FIG. 4 shows a longitudinal section through a side cover.
Figure 6:
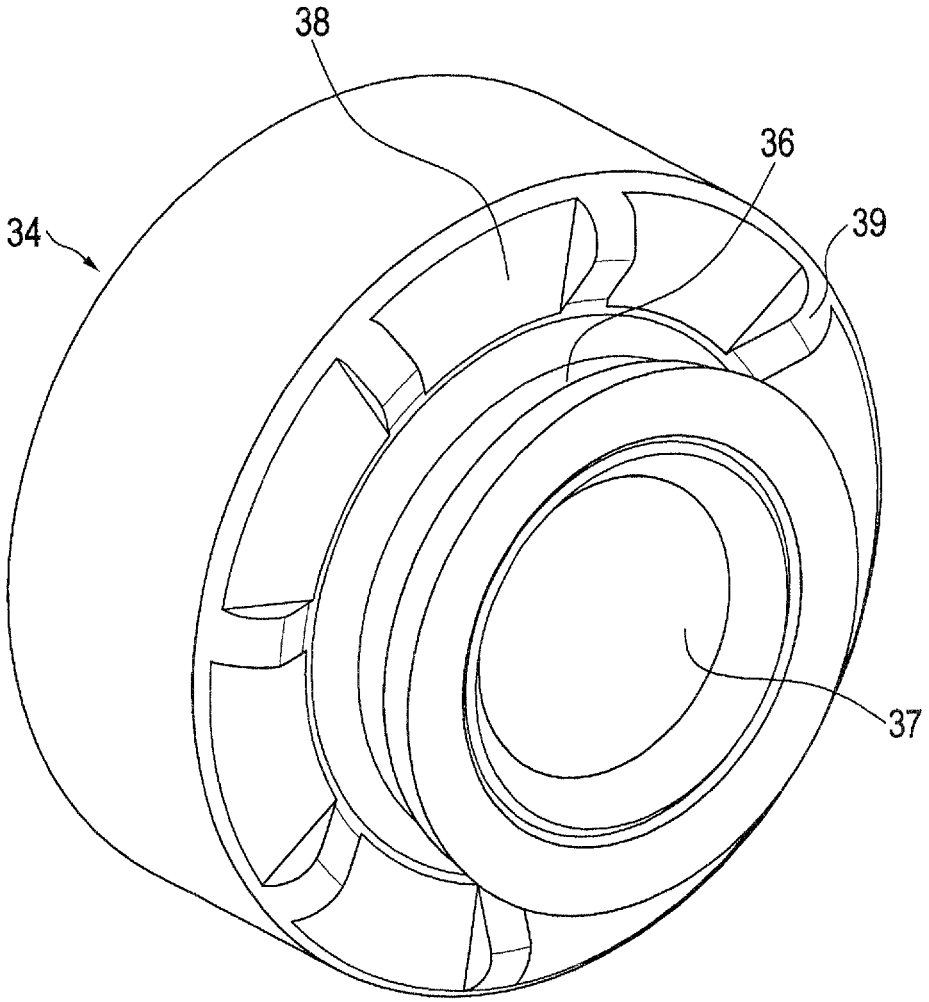
FIG. 6 shows a perspective illustration of a mating element.

FIGS. 4, 5 show the first side cover 24 before mounting to the apparatus 10. The side cover 24 comprises a thin-walled sealing cover 35, in which five openings 33 are provided. During mounting of the first side cover 24, each of the openings 33 is assigned in each case a thread carrier 34. FIG. 6 shows a thread carrier 34 by way of example. Said thread carrier 34 has a stepped profile with a projection 36 in cross section. Furthermore, a thread section 37 is provided within a hole of the thread carrier 34. The external diameter of the projection 36 is adapted to the internal diameter of the openings 33 at least in a part region and therefore serves as centering collar, in order to position the thread carrier 34 at the respective opening 33. The projection 36 is adjoined by an annular region which serves as axial stop 38, the latter bearing against the sealing cover 35 in the mounted state of the thread carrier 34. The axial stop 38 is provided with a plurality of anti-rotation safeguard elements 39 which extend in the axial direction starting from the annular face.

Figures 7, 8, 9:
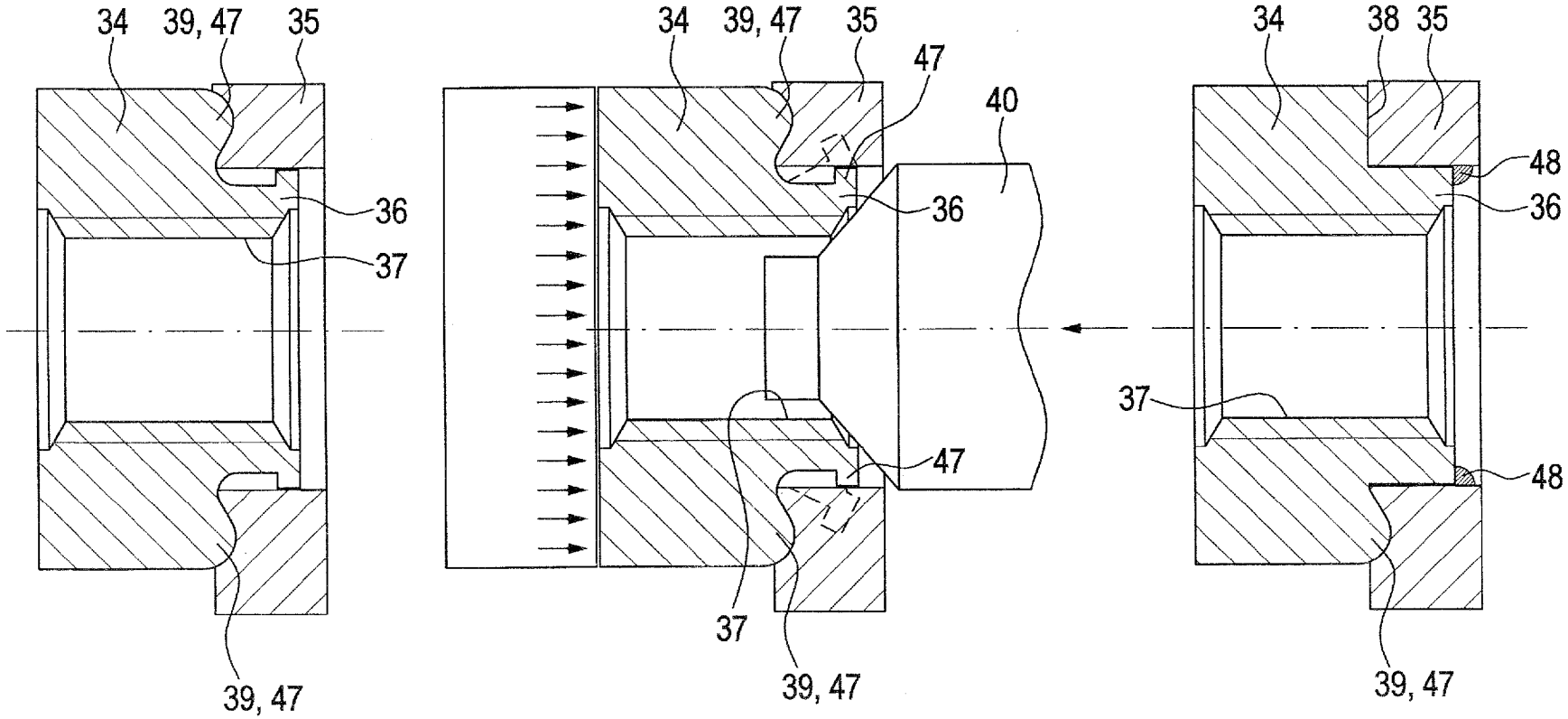
FIG. 7 shows the detail Z from FIG. 4 before mounting of the mating element.
FIG. 8 shows the detail Z from FIG. 4 during mounting of the mating element.
FIG. 9 shows the detail Z from FIG. 4 of a further embodiment of a sealing cover according to the invention.

FIGS. 7, 8 show the mounting of the thread carrier 34 on the sealing cover 35. First, the projection 36 is inserted into the opening 33. Here, an axially directed force is exerted on the thread carrier 34, which force is sufficient to press the anti-rotation safeguard elements 39 into the axial side face of the sealing cover 35. Subsequently, a conical mandrel 40 engages into the hole of the thread carrier 34, as a result of which the front edge region of the projection 36 is widened in the radial direction. Here, one or more positively locking elements 47 is/are displaced into the circumferential face of the opening 33, as a result of which an additional positive connection is produced between the sealing cover 35 and the thread carrier 34. The positively locking elements 47 can be, for example, an annular radial collar or radial tongues on the projection 36.

In this embodiment, the thread carrier 34 is secured against rotations relative to the first side cover 24 by means of a positive connection via the antirotation safeguard elements 39 and a further positive connection of the front region of the projection 36. At the same time, the second positive connection acts in the axial direction, with the result that the thread carrier 34 is held in the opening 33.

Embodiments without anti-rotation safeguard elements 39 are likewise conceivable, with the result that the connection is produced only between the widened front region of the projection 36 and the circumferential face of the opening 33.

A further alternative embodiment is shown in FIG. 9. In this embodiment, the external diameter of the projection 36 is configured to be slightly greater than the internal diameter of the opening 33. The projection 36 is pressed into the opening 33 with the production of a press fit connection. Here, anti-rotation safeguard elements 39 can be provided (lower part of the figure) or they can be omitted (upper part of the Figure). To this end, the sealing cover 35 and the mating elements 34 are produced separately. The openings 33 are formed on the sealing cover 35, the outer contour of the projection 36 of the mating element 34 being of oversized configuration with respect to the opening 33 of the sealing cover 35. Subsequently, the projection 36 is pressed into the openings 33 with the production of a press joint.

In addition to one of the preceding embodiments or as an alternative to it, a material-to-material connection 48 can be provided between the mating element 34 and the sealing cover 35. The material-to-material connection 48 can be formed, for example, between the projection 36 and the circumferential face of the opening 33 or the mating element 34 and an axial side face of the first side cover 24. In the latter case, the projection 36 can also be omitted.

In this case, the sealing cover 35 and the mating elements 34 are produced separately. The openings 33 are formed on the sealing cover 35, the outer contour of the projection 36 (if present) being adapted to the circumferential face of the opening 33 of the sealing cover 35. Subsequently, the mating element 34 is positioned on the opening 33. If there is a projection 36, it is positioned in the opening 33. Subsequently, the material-to-material connection 48 is produced between the sealing cover 35 and the mating element 34. Here, the material-to-material connection 48 can be, for example, a welded connection, a soldered connection, an adhesively bonded connection or a similar connection.

A pressure space 41 is formed within the apparatus 10 between in each case two side walls 30 which are adjacent in the circumferential direction. Each of the pressure spaces 41 is delimited in the circumferential direction by substantially radially extending bounding walls 42 of adjacent side walls 30, which bounding walls 42 lie opposite one another, in the axial direction by the side covers 24, 25, radially to the inside by the hub element 26 and radially to the outside by the circumferential wall 29. A vane 27 projects into each of the pressure spaces 41, the vanes 27 being configured in such a way that they bear both against the side covers 24, 25 and against the circumferential wall 29. Each vane 27 therefore divides the respective pressure space 41 into two pressure chambers 45, 46 which act against one another.

The output element 23 can be rotated in a defined angular range with respect to the drive element 22. The angular range is delimited in one rotational direction of the output element 23 by the fact that the vanes 27 come to bear against in each case one corresponding bounding wall 42 (early stop 43) of the pressure spaces 41. In an analogous manner, the angular range is delimited in the other rotational direction by the fact that the vanes 27 come to bear against the other bounding walls 42 of the pressure spaces 41, which bounding walls 42 act as late stop 44.

The phase position of the drive element 22 with respect to the output element 23 (and therefore the phase position of the camshaft with respect to the crankshaft) can be varied by pressure loading of one group of pressure chambers 45, 46 and pressure relief of the other group. The phase position can be kept constant by pressure loading of both groups of pressure chambers 45, 46.

LIST OF DESIGNATIONS

1 Internal combustion engine
2 Crankshaft
3 Piston
4 Cylinder
5 Flexible drive
6 Inlet camshaft
7 Outlet camshaft
8 Cam
9*a* Inlet gas exchange valve
9*b* Outlet gas exchange valve
10 Apparatus
21 Pulley
22 Drive element
22*a* Housing
23 Output element
24 Side cover
25 Side cover
26 Hub element
27 Vane
-
29 Circumferential wall
30 Side wall
31 Axial opening
32 Fastening element/screw
33 Opening
34 Mating element/thread carrier
35 Sealing cover
36 Projection
37 Thread section
38 Axial stop
39 Anti-rotation safeguard element
40 Mandrel
41 Pressure space
42 Bounding wall
43 Early stop
44 Late stop
45 First pressure chamber
46 Second pressure chamber
47 Positively locking element
48 Material-to-material connection

The invention claimed is:

1. An apparatus for variable setting of control times of gas exchange valves of an internal combustion engine, comprising:

a drive element brought into drive connection with a crankshaft of the internal combustion engine;

an output element brought into drive connection with a camshaft of the internal combustion engine, the output element being arranged such that the output element is pivotable with respect to the drive element; and a side cover axially delimiting the output element and/or the drive element and being connected in a rotationally fixed manner to the drive element or the output element by at least one fastening element, the side cover having a sealing cover and at least one mating element, the sealing cover being composed at least partially of a metallic material and having at least one opening, and the fastening element reaching through the opening at least partially and interacting with the mating element in such a way that a rotationally fixed connection can be produced between the side cover and the output element or the drive element wherein the mating element is configured separately with respect to the sealing cover and is connected to the sealing cover independently from the fastening element, the mating element having an axial projection inserted in the opening with at least one positively locking element extending radially outward inside the opening into the side cover radially past a circumferential face of the opening thereby forming a positive locking connection between the mating element and the sealing cover, an axial edge of the axial projection being inside the opening, the at least one positively locking element comprising an annular radial collar or radial tongues of the projection.

2. The apparatus according to claim 1, wherein the mating element has an axial stop which bears against an axial side face of the sealing cover when the mating element is mounted.

3. The apparatus according to claim 2, wherein the axial stop is configured as an annular face.

4. The apparatus according to claim 3, wherein the annular face is provided with anti-rotation safeguard elements which extend in an axial direction starting from an annular face.

5. The apparatus according to claim 4, wherein the anti-rotation safeguards have a substantially convex shape as viewed in cross-section.

6. The apparatus according to claim 1, wherein the side cover is produced separately from the output element and the drive element.

7. The apparatus according to claim 1, wherein the mating element is arranged at least partially on a side of the sealing cover which faces away from the output element or the drive element.

8. The apparatus according to claim 1, wherein the side cover has a central hole and a flange extending axially from the side cover at the central hole.

9. The apparatus according to claim 1, wherein the mating element is permanently fixed in a non-rotatable manner to the sealing cover.

* * * * *